US005105585A

United States Patent [19]

Hampl et al.

[11] Patent Number: 5,105,585

[45] Date of Patent: Apr. 21, 1992

[54] DUST EMISSIONS CONTROL MECHANISM FOR HAND SANDERS

[75] Inventors: Vladimir Hampl, Pleasant Plain, Ohio; Jennifer L. Topmiller, Florence, Ky.; Daniel W. Watkins, Hamilton, Ohio

[73] Assignee: The United States of America as represented by the Department of Health and Human Services, Washington, D.C.

[21] Appl. No.: 691,895

[22] Filed: Apr. 26, 1991

[51] Int. Cl.[5] ..... B24B 23/00; B24B 55/06

[52] U.S. Cl. ..... 51/170 R; 51/273

[58] Field of Search ..... 51/170 R, 170 MT, 273, 51/170 T

[56] References Cited

U.S. PATENT DOCUMENTS

| | | | |
|---|---|---|---|
| 2,268,863 | 1/1942 | Emmons . | |
| 2,329,995 | 9/1943 | Koether . | |
| 2,478,074 | 6/1949 | Atkin . | |
| 2,944,465 | 7/1960 | Jones . | |
| 3,646,712 | 3/1972 | Quintana . | |
| 3,785,092 | 1/1974 | Hutchins . | |
| 3,932,966 | 1/1976 | Stern . | |
| 4,058,936 | 11/1977 | Marton | 51/170 T |
| 4,135,334 | 1/1979 | Rüdiger . | |
| 4,145,848 | 3/1979 | Hutchins | 51/273 |
| 4,531,329 | 6/1985 | Huber . | |
| 4,549,371 | 10/1985 | Hakoda . | |
| 4,660,329 | 4/1987 | Hutchins . | |
| 4,671,020 | 6/1987 | Hutchins . | |
| 4,729,195 | 3/1988 | Berger . | |
| 4,765,099 | 8/1988 | Tanner . | |
| 4,839,995 | 6/1989 | Hutchins . | |
| 4,930,264 | 6/1990 | Huang . | |
| 4,932,163 | 6/1990 | Chilton et al. . | |
| 4,967,516 | 11/1990 | Hoshino . | |
| 4,986,703 | 1/1991 | Hampl et al. . | |

FOREIGN PATENT DOCUMENTS

| | | | |
|---|---|---|---|
| 3413028 | 10/1985 | Fed. Rep. of Germany | 51/273 |
| 0139667 | 6/1988 | Japan | 51/273 |
| 0150164 | 6/1988 | Japan | 51/273 |

*Primary Examiner*—Roscoe V. Parker

*Attorney, Agent, or Firm*—Lowe, Price, LeBlanc & Becker

[57] ABSTRACT

A mechanism is provided to significantly enhance control over the emission of particulate dust typically generated during operation of a hand-held sander. A suction manifold coupled to any conventional means for providing suction is fitted to the outside of the sander body and communicates through a plurality of connection tubes with a plenum through which particulates generated during sanding are sucked in through apertures in a sanding pad of the sander. Further enhancement of removal of the particulates is obtained by a plurality of grooves in the sanding surface of the sanding pad of the sander, such grooves each having an inside end communicating with a corresponding one of a plurality of apertures through the sanding disk, each groove also having an outside end at an outer periphery of the sanding pad. The provision of supplemental suction through the suction manifold and the use of a grooved sanding disk, as described, significantly reduces particulate emissions and, simultaneously, reduces the suction-induced tendency for the sander to be drawn toward the surface of a workpiece being sanded thereby.

18 Claims, 3 Drawing Sheets

DUST EMISSIONS CONTROL MECHANISM FOR HAND SANDERS

FIELD OF THE INVENTION

This invention relates to mechanisms for reducing dust emissions from a hand sander having a rotating or orbital sanding pad, and more particularly to a dust control device usable with either an electrical and an air-powered hand sander which allows the sander to be readily movable over the surface of a workpiece even when a strong vacuum is applied thereat to suck away dust generated by the sanding operation.

BACKGROUND OF THE PRIOR ART

The difficulty of controlling fine particulate dust emissions from operation of a hand tool such as a sander having a rotating or orbital sanding pad is well known. Local exhaust ventilation, to carry away the fine dust in a vacuum-induced flow of air, is the primary method of controlling, for example, wood dust emissions at most woodworking machines. However, this system, in general, cannot be successfully utilized with hand sanding operations because of the large variety of operator movements and the wide variation of hand sanding operations. Consequently, quite often, fine dust emissions from hand sanders are not adequately controlled and create respiratory problems.

Numerous solutions to this problem are known, and a few examples are described hereinbelow.

U.S. Pat. No. 3,646,712, to Quintana, teaches a dust-removing attachment device for use with rotary disk power grinders or sanders. In this device, a continuous current of air is maintained over and around the grinding or sanding surface to capture and withdraw dust particles and the like into a vacuum chamber. The continuous current of air is promoted by the application of a vacuum to the sander by a vacuum cleaner connected to a plenum which entirely covers the rotary sanding pad.

U.S. Pat. No. 4,135,334, to Rüdiger, teaches the provision of a hood, which extends around a rotating sanding pad and reaches down to the sanded surface while totally surrounding and covering the sanding pad. Vacuum is provided by a dust exhaust device connected to a periphery of the hood.

U.S. Pat. No. 4,765,099, to Tanner, teaches a device utilizing two air-powered impeller assemblies provided with blades to generate a vortex-like suction during blade rotation. The first impeller assembly captures the dust particles and discharges them upwardly toward the second impeller assembly. The particles are then directed toward the exhaust and a collection bag provided thereat to catch the dust. The entire system is located in a special housing and is provided with a brush which surrounds the exhaust pad.

U.S. Pat. No. 3,785,092, to Hutchins, teaches a dust emission control device suitable for use with air-powered rotary hand-sanders. It includes a sanding pad provided with a set of through-holes, an aspirator, and a shroud. Energy is derived from the exhaust of an air motor driving the sanding pad, preferably through an aspirator action. The compressed air earlier used to drive the motor flows through the aspirator to generate a suction which captures dust particles, pulled with air flowing through the pad holes, toward a collector. The shroud extends around the sanding pad and, in reaching the sanded workpiece surface, entirely surrounds the sanding pad.

U.S. Pat. No. 4,531,329, to Huber, teaches the use of a resiliently deformable lip arranged to engage with a surface of a driven sanding pad close to a periphery of the pad. This enables a controlled vacuum-induced flow of dust by rotary motion of the sanding pad into the shroud while, at the same time, avoiding the production of a vacuum-induced braking effect on movements of the sanding pad. This is accomplished by providing a plurality of circularly distributed apertures through a conventional diskshaped sanding pad, which has a frusto-conically shaped side wall and which is contacted by the resilient lip of the exhaust shroud. In an alternative embodiment, the resilient lip of the shroud extends around and beyond the periphery of the rotating sanding member.

Commercially-available known dust emissions control apparatus, constructed generally in accordance with the teaching of Huber, is illustrated in partial vertical cross-sectional view in FIG. 1. This system is somewhat ineffective because of the difficulty of applying a sufficiently strong vacuum by the aspirator. Although the device reduces dust emissions somewhat, it does not do so very efficiently and some dust may still be emitted into the ambient atmosphere during operation of the tool.

There is, accordingly, a need for a dust emissions control mechanism which can be operated with an otherwise conventionally constructed rotary or orbital type sander, i.e., a hand-held tool, in which there is a rotating or orbital motion sanding pad having a sanding surface contacting a workpiece, without generating such vacuum-generated forces between the tool and the workpiece as would interfere with free and unrestricted user-controlled movement of the sander during its operation.

SUMMARY OF THE DISCLOSURE

Accordingly, it is a principal object of the present invention to provide a dust emissions control device usable with a hand-held sanding tool, employing rotary or orbital motion of a sanding pad, for efficiently applying a vacuum to remove dust generated during operation of the sanding tool.

It is another object of the present invention to provide a hand-held sanding tool which has a rotary or orbital sanding pad which utilizes an externallyapplied vacuum to efficiently collect and remove dust generated during a sanding operation without generating a significant vacuum-induced force tending to draw the hand-held tool to the surface being sanded.

In a related aspect of this invention, it is an even further object to provide a geometric form for a sanding pad suitable for use with a hand-held sanding tool fitted with suction means to efficiently suck away dust generated by operation of an abrasive surface provided on the sanding pad while minimizing the magnitude of any vacuum-generated force tending to draw the hand-held tool to the workpiece being sanded.

These and other related objects are realized in a preferred embodiment of this invention by providing a sanding pad, including a body of predetermined thickness to which an abrasive layer is attached to provide a substantially flat sanding surface wherein the body has a plurality of apertures extending through the body and the abrasive layer (usually sanding paper) and disposed about an axis normal to the flat sanding surface. There is also provided a plurality of grooves formed in the body to extend to a predetermined depth into the thickness of the pad body. The grooves each have an inside end communicating with a corresponding one of said apertures and an outside end opening at an outer periphery of the pad body.

DESCRIPTION OF THE PREFERRED EMBODIMENTS

Figure 1:
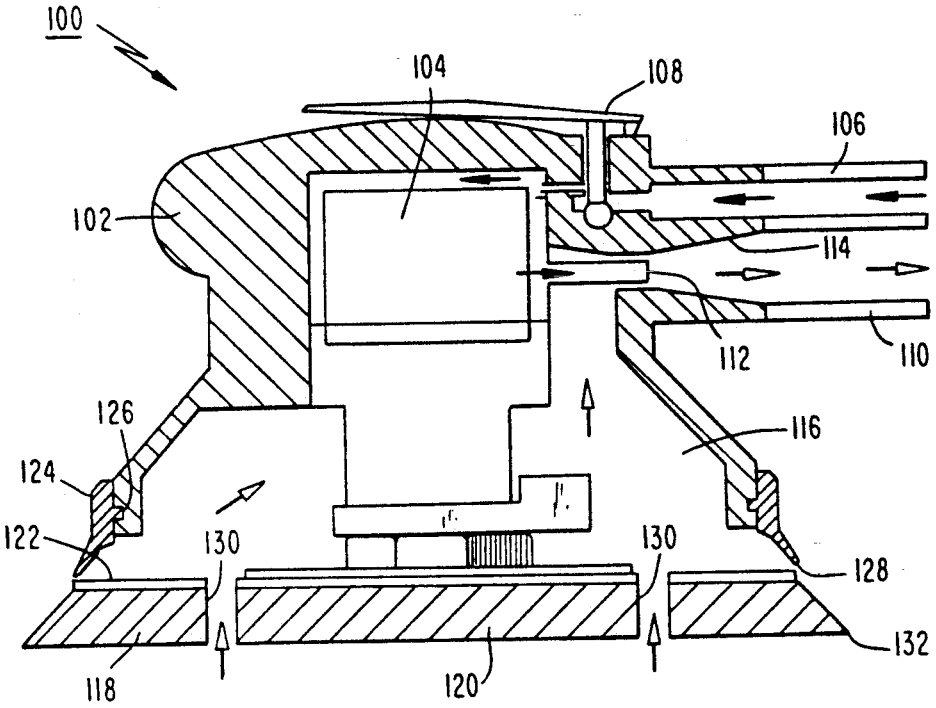
Fig. 1 (PRIOR ART)
FIG. 1 is a partial vertical cross-sectional view of a known hand-held rotary sanding tool with dust emissions control.

FIG. 1 illustrates, in vertical cross-sectional schematic view, the principal components of a known hand-held sander, i.e., a sanding tool, having a compressed air drive motor.

Sander 100 has a main body 102 supporting a compressed air drive motor 104 supplied with a flow of compressed air (indicated by solid black arrows) through a compressed air supply line 106. The hand-operated compressed air flow control valve 108 is located to be conveniently operable by a user of the sander. The flow of compressed air expands through motor 104 and is thereafter expelled from the sander through air exhaust line 110 which, because of the higher specific volume of the exhausted air, typically would have a somewhat larger diameter than compressed air inlet line 106.

The exact details of the structures of the fittings by which lines 106 and 110 are fitted to body 102 of the sander are not critical to the present invention and may be adapted by persons of ordinary skill in the art to suit the size and particular application of interest. What is important to appreciate, however, is that where the drive motor utilizes compressed air for power, the exhaust air, still at a relatively high pressure compared to that of the ambient atmosphere leaves the drive motor 104 through a short tube 112 which is disposed centrally in the throat of a short venturi nozzle-type opening 114 through which it expands into exhaust air line 110. As persons of ordinary skill in the fluid mechanics art will appreciate, such an arrangement will generate an aspiration of air past and around the outside of short tube 112, through the plenum beneath the short tube 112 within the body of sander 100. In the known device illustrated in FIG. 1, such an aspiration of air is used to generate a suction within plenum 116 and may be utilized to carry fine particulate emissions generated by operation of the sander with incoming ambient air.

In the prior art device illustrated in FIG. 1, air drive motor 104 has a downwardly depending drive shaft at the distal end of which is fitted a sanding pad 118 which has an outside sanding surface 120, covered with sanding paper having matching apertures formed therein to be applicable to a surface of a workpiece being sanded thereby, and an inside surface 122. There are many power sanders available in the market. These may apply pure rotation to a rotary disk or pad or, for fine sanding or polishing operations an additional orbital motion to a pad. The mechanisms for both, e.g., gearing, etc. are well known. The present invention is applicable, with obvious differences, to either kind of power tool. A flexible skirt-type element 124 is fitted, e.g., by engagement with a groove 126 around the lower portion of sander body 102. Flexible element 124 has a distal circumferential lip 128 normally disposed to be immediately adjacent a rim of inside surface 112 of sanding pad 118.

When such a sander is operated by manipulation of compressed air inlet valve 108, drive motor 104 causes sanding pad 118 to be put into operational motion. The flow of exhausted air from air motor 104 through venturi nozzle 114 aspirates air through plenum 116, which results in the plenum being at a sub-atmospheric pressure. Flexible skirt 124 then may deflect so that its lip 128 is drawn closer, possibly into light contact with a peripheral portion of inner surface 122 of sanding pad 118. In effect, this helps to seal the plenum and improves the suction provided thereto. In this known sander, which corresponds to the teaching of the Huber patent (U.S. Pat. No. 4,531,323), a plurality of through apertures 130 are formed in sanding pad 118. As sanding surface 120 is applied to a workpiece (not shown) material from the workpiece (and possibly some from the abrasive paper applied to the sanding pad) they may be comminuted as fine particles which could be blown away from sander 100 during its operation and spread to pollute the nearby atmosphere. When sanding pad 118 is rotated, there can be centrifugal flow of ambient air tending to spread the dust. However, with the aspiration generated by exhausted air flowing through venturi nozzle 114, the vacuum within plenum 116 induces an inward air flow between the workpiece surface being sanded and the sanding surface 120. This air flow, which is bound to be very small because sanding pad 118 is being firmly pressed to the workpiece to accomplish the intended sanding, entrains a portion of the fine particulates between sanding surface 120 and the workpiece to draw them through moving apertures 130, through plenum 116, and thus out with exhausted air flowing away from the sander 100 through exhaust air line 110.

In practice, there are two forces tending to close the gap between sanding surface 120 and the immediately adjacent surface of the workpiece. These are, first, the weight and/or force being applied by the user to the sander body toward the workpiece and, second, a consequence of the fact that plenum 116 is at subatmospheric pressure which may be significantly increased by the application of additional vacuum. The latter factor results in a pressure difference between the outside projected surface area corresponding to sander 110 and its sanding pad 118 which tends to further drive sander 100 toward the workpiece. As persons of ordinary skill in the art will appreciate, while a user may desire to selectively force sanding surface 120 against the workpiece, the essence of successful sanding is to be able to freely move the sanding surface 120 laterally or in a general three-dimensional motion depending upon the shape of the workpiece being sanded. Any tendency of the pressure difference between plenum 116 and the ambient atmosphere to forcibly draw sanding surface 120 to the workpiece can, therefore, interfere with the freedom of the user to effectively manipulate sander 100 during its operation.

The above description of the closest prior art is believed to be necessary for a proper understanding to be obtained of the advantages made available by the present invention, details of which are discussed fully hereinbelow.

Figure 2:
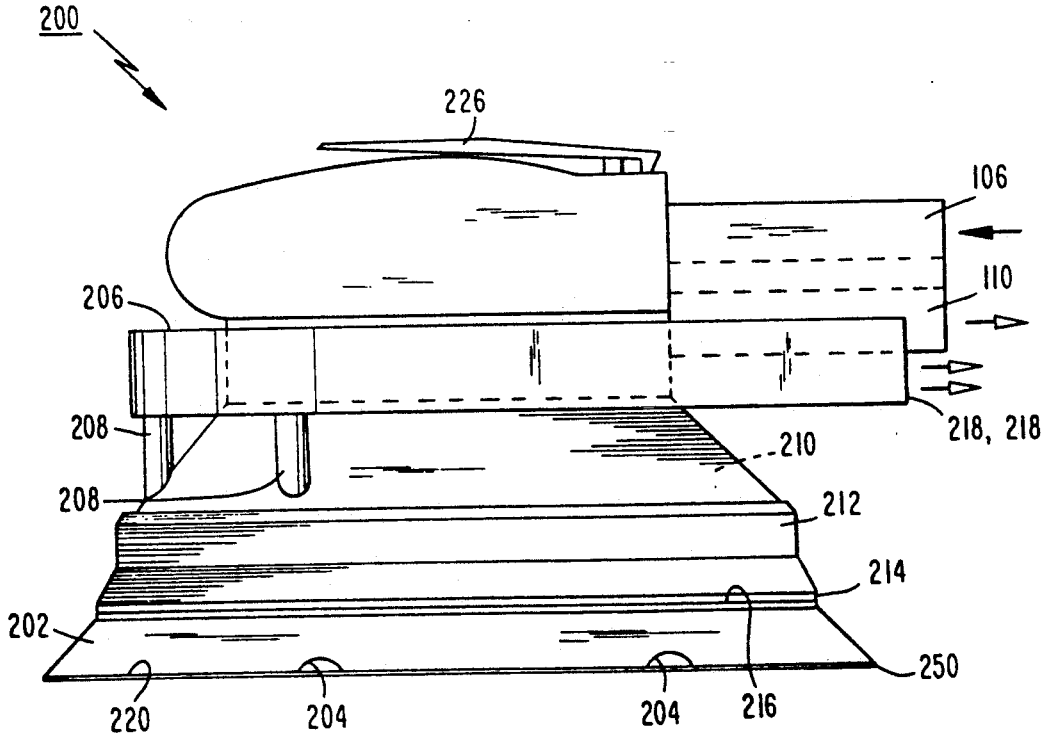
FIG. 2 is a side elevation view of a hand-held rotary sanding tool in accordance with a preferred embodiment of the present invention.

As best seen in FIG. 2, the present invention comprises two significant modifications of the above-discussed prior art. Thus, in the preferred embodiment illustrated in side elevation view in FIG. 2, sander 200 comprises a sanding pad 202 which has a plurality of grooves 204, 204 formed into its sanding surface to a predetermined depth and of predetermined cross section. Together with this modification of the conventional sanding pad, there may also be employed a suction manifold 206 which is shaped and sized to fit conveniently around an upper outside portion of the body of the sander 200. Suction manifold 206 is fitted with a plurality of connection tubes 208 to enable communication with the plenum 210 thereunder. As with sander 100 illustrated in FIG. 1, sander 200 illustrated in FIG. 2 is also fitted with a comparable flexible skirt element 212 which has a lower and outermost lip 214 immediately adjacent upper surface 216 of sanding pad 202.

Figure 3:
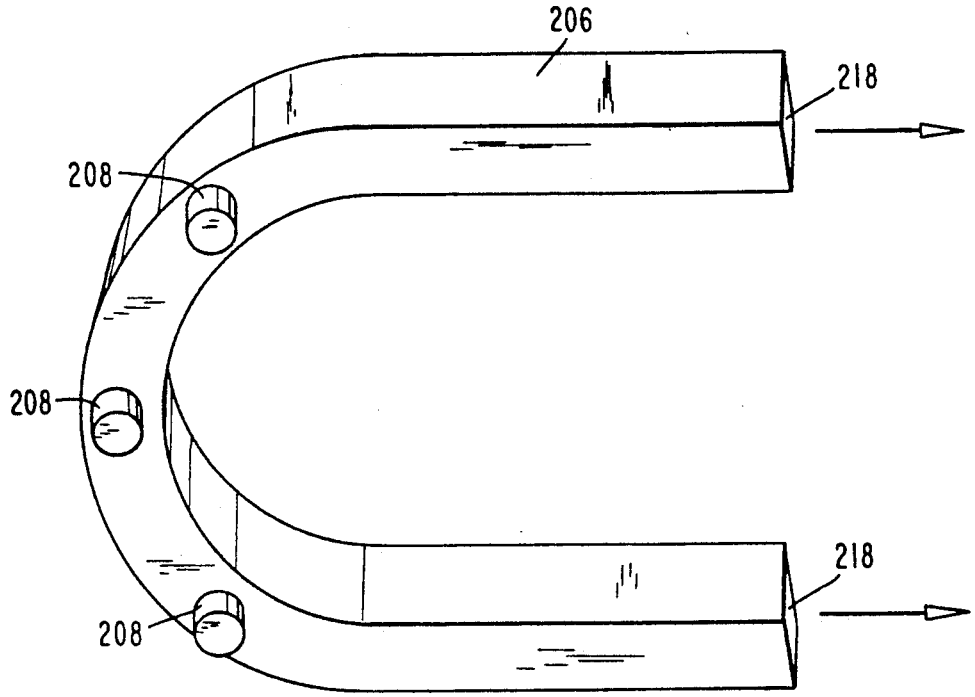
FIG. 3 is a perspective view of a portion of a manifold employed to apply suction in the preferred embodiment of FIG. 2 to efficiently remove dust.

As best seen in FIG. 3, a convenient form for suction manifold 206 is a U-shape, and a convenient cross-section therefor is a substantially square or rectangular one. As noted earlier, a plurality of connection tubes 208 allow suction communication between the inside of suction manifold 206 and plenum 210. It should be noted that although only three connection tubes 208 are illustrated in the preferred embodiment of suction manifold 206 in FIG. 3, more such connection tubes may be employed to suit specific circumstances of use of the sander. Thus, for example, if such a sander is employed to apply its fine sanding action to a very hard metal, any fine particulates of the metal may represent an unacceptable economic loss or, worse, present a significant environmental hazard. Also, if the metal particulates have a high mass density, then significant suction may have to be provided by suction manifold 206. This may be facilitated by the provision of more than three connecting tubes 208, suitably distributed around plenum 210 to provide effective suction thereto. Such details, all of which are within the scope of the present invention, are best left to the individual designer seeking to employ the teaching of the present invention.

As will be appreciated, both ends 218, 218 of suction manifold 206 may be connected by suitable suction lines (not shown in FIG. 3, but see FIG. 4) to apply the desired suction. For most applications in the home or in a small workshop, such suction may be adequately provided by connecting the sander to the suction port of a home or conventional industrial vacuum cleaner. What matters is that an adequate suction be provided while sanding surface 220 of sanding pad 202 covered by an abrasive layer, e.g., sand paper is being applied to a workpiece. Such an abrasive layer of sand paper 250 must have through apertures disposed to match apertures 130 in the pad body and may be applied to the sanding surface by any conventional adhesive. An exhausted abrasive sand paper layer can thus be readily peeled off and a replacement therefor applied quickly. In effect, each groove and the inside surface of the sand paper 250 applied to the sanding pad 202 form a duct communicating with a corresponding one of apertures 130 in pad body 202 to create a low pressure region around the outer periphery of the sanding pad to such in dust thereat.

Incidentally, it should be noted that although the prior art sander per FIG. 1 was discussed as being one utilizing a compressed air drive motor, the present invention is perfectly suited for use with either a compressed air type sander or one driven by an electrically powered motor. Thus, with very obvious modifications, e.g., the provision of an electrical line and an electrical motor to replace the compressed air motor and air inlet and outlet lines 106 and 110 respectively, the suction manifold 206 and grooved sanding pad 202 may be used with equal facility with an electrically driven sander. In such a case, compressed air flow control valve 226 would simply be replaced by an electrical switch for controlling flow of electrical power to an electrical drive motor. Such alternatives are believed to be comprehended with the present disclosure and hence repetitious details thereof are not provided.

Figure 4:
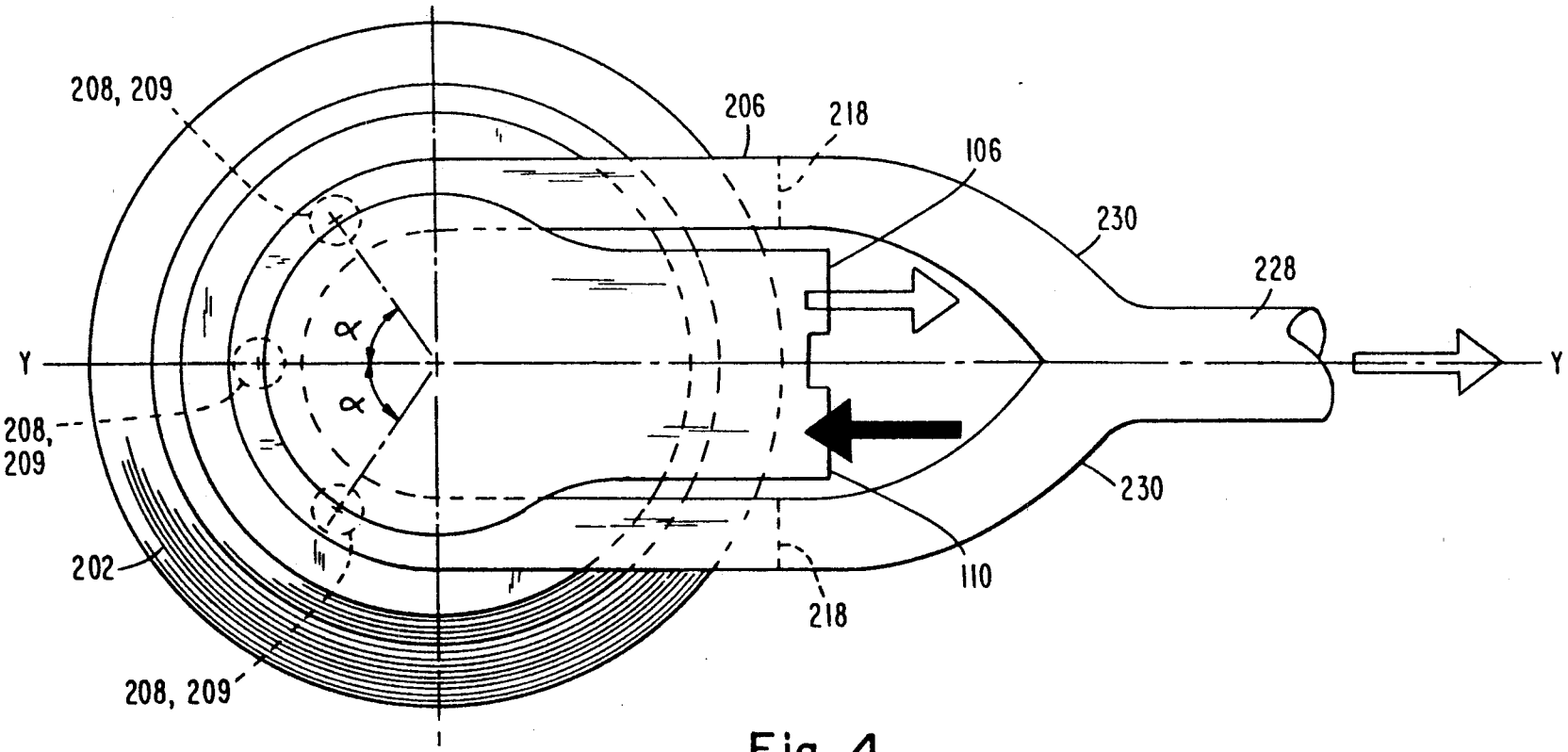
FIG. 4 is a plan view of the preferred embodiment of this invention according to FIG. 2.

For convenience, FIG. 4 illustrates how the two ends 218, 218 of suction manifold 206 can be coupled to a Y-type single suction line 228. Branches 230, 230 of the single suction line 228 would connect respectively with ends 218, 218 of suction manifold 206. This would reduce the number of separate lines being connected to the sander and, thus, facilitate handling of the sander by a user. In FIG. 4, connecting tubes 208 are illustrated as being symmetrically disposed, at corresponding suction ports 209,209 formed in a wall of suction manifold 206, at respective angles "$\alpha$" with respect to a longitudinal line of symmetry Y—Y. Exemplary conventional parameters for a hand-held sander 200 fitted with a suction manifold as illustrated in FIGS. 2, 3 and 4 are as follows: suction manifold 206 has a generally rectangular section approximately $0.5'' \times 0.75''$, and the three connecting tubes 208 each are of approximately 0.375" outer diameter, with $\alpha$ approximately equal to 60°.

Although the provision of suction manifold 206, as discussed hereinabove with reference to appropriate illustrations, will significantly enhance the collection of fine particulate emissions during operation of the sander even with the known merely apertured sanding pad 118 (illustrated in FIG. 1), even more effective particulate emission control is made possible by a further modification of the sanding surface of the sanding pad.

Figure 5:
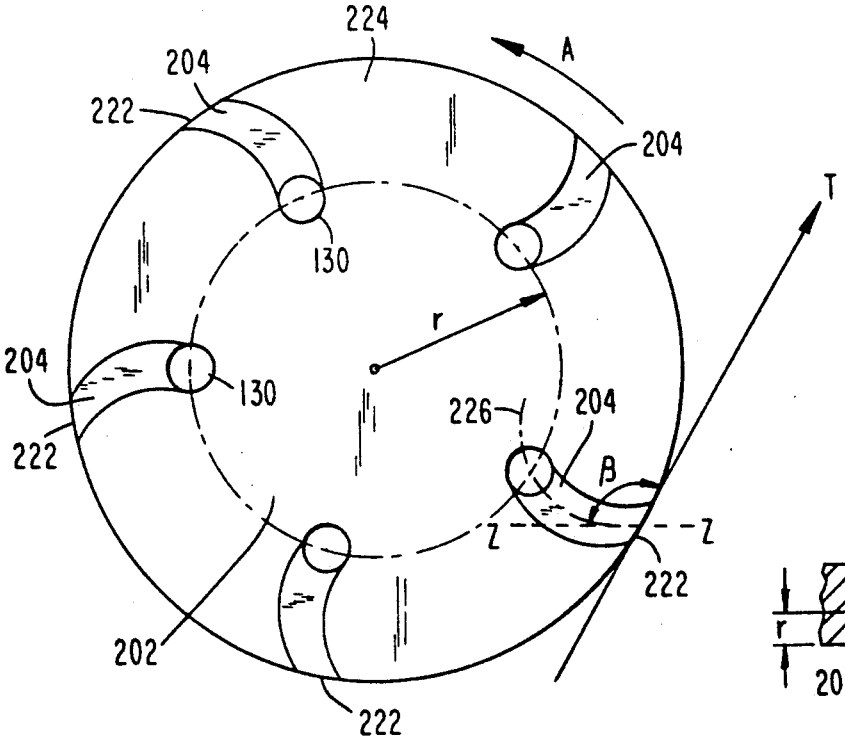
FIG. 5 is a plan view of the sanding surface of a sanding pad in accordance with the preferred embodiment of this invention per FIG. 2.

As best seen in FIG. 5, this additional improvement involves the provision of a plurality of grooves, each communicating with one of the plurality of apertures 130 at an inside end. Each groove 204 has an opening 222 at the outside periphery of sanding pad 202. There are two significant advantages that become available by the provision of such grooves 204. The system of the grooves 204 connecting the holes 130 with the pad periphery allows for the capture of dust at the periphery of the pad 202 where most of the dust is originated. This does not occur when the prior art control, lacking grooves 204, is used. The second principal advantage obtained by the provision of grooves 204 is to make possible a much larger air flow through the plenum 210 and consequently a higher vacuum without any increase in the force drawing the sanding surface 220 to the workpiece since the available area for such an air flow between the ambient atmosphere and plenum 210 is significantly larger than is available without the presence of grooves 204, i.e., simply through the very narrow gap between sanding surface 120 and the workpiece as best understood with reference to FIG. 1.

In the preferred embodiment of the sanding pad, as illustrated in FIG. 5, it will be seen that each groove 204 is curved so that its outside end is directed forwardly, i.e., in the direction of arrow A. For an exemplary groove 204, FIG. 5 also shows a tangent "T" with an arrowhead pointed in the direction in which the corresponding outside opening 222 is moving. It is believed, on the basis of experiment and analysis, that having an axis 226 characteristic of the curved groove 204 inclined at an angle $\beta$ within the range 110°-120° tends to optimize the flow of air through the groove 204 to best enhance the desired emissions suppression. This angle "$\beta$" is best seen in FIG. 5 as being the angle between broken line Z—Z tangential to curved axis 226 at the outer periphery of sanding pad 202 and tangent line "T".

Figure 6:
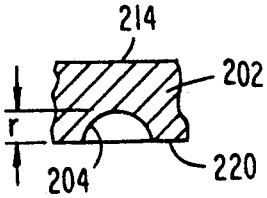
FIG. 6 is an end view of an exemplary groove formed in the sanding surface of the sanding pad according to FIG. 5.

FIG. 6 illustrates a preferred embodiment for the shape of the cross-section of grooves 204. This is a generally semi-circular shape of radius "r". It is believed that this shape is most easy to form in a sanding pad to be covered by a precut and pre-apertured sanding paper 250 at sanding face 220, and that it would optimize the air flow through the grooves during operation of the device. Naturally, persons of ordinary skill in the art can be expected to consider other cross-sectional shapes for grooves 204.

As noted, the optimum benefits of the present invention are realized by the combined provision of both a suction through suction manifold 206 as well as a grooved sanding pad 202, as illustrated and described hereinabove. Nevertheless, for example in a conventional sander utilizing merely an aperture sanding pad (FIG. 1) even the mere provision of supplemental suction, through a manifold 206 added to a conventional aspirator type suction-generating means as illustrated in FIG. 1, will significantly enhance pick up of particulate emissions. Similarly, the provision of a grooved sanding pad, for example per FIGS. 5 and 6, to a conventional compressed air driven sander (per FIG. 1) will have an enhanced inward air flow and, therefore, better pick-up of particulates, especially at the periphery of the pad 202. The optimum advantage may be realized by providing both additional suction through manifold 206 and improved air flow to pick up the particulate emissions by the provision of a grooved sanding pad as described.

It is anticipated that persons of ordinary skill in the art, upon comprehending the present invention as described and illustrated herein, will consider obvious modifications and changes thereto. It should also be appreciated that the specific advantages disclosed herein with reference to the preferred embodiments may be modified in obvious manner to obtain optimum advantage according to this invention for specific applications. Particular details illustrated and discussed in this disclosure, therefore, should be regarded merely as exemplary and not as limiting, the invention being defined solely by the claims appended hereunder.

What is claimed is:

1. A sanding pad, comprising:

a body of predetermined thickness; and a plurality of apertures which extend through the thickness of said body; and a plurality of curved grooves formed at a sanding surface of the body to extend to a predetermined depth into the thickness of the body, said grooves each having an inside end communicating with an aperture and an outside end opening at an outer periphery of the pad body each groove curving forwardly in a direction of rotation of the sanding pad with a characteristic axis of each groove intersecting a tangent at the pad periphery at an angle in the range of 110°-120°.

2. A sanding pad according to claim 1, wherein:

said apertures are symmetrically disposed with their respective centers located on a circle of predetermined radius with respect to an axis of the body.

3. A sanding pad according to claim 1, wherein:

each of said grooves has a substantially semicircular transverse cross-section.

4. A sanding pad according to claim 2, further comprising:

an abrasive layer attached to said sanding surface, said abrasive layer having formed therein a plurality of apertures disposed in correspondence with the apertures of said body.

5. A mechanism for suppressing dust emissions from a power sander comprising a sanding pad driven in one of a rotary or a combined rotary and orbital motion to sand a surface of a workpiece, the sanding pad having a sanding side and an inner side, comprising:

a plenum formed in a body portion of the sander so as to extend around a drive shaft of the sander to which the sanding pad is operationally attached, the plenum being partially defined by the inner surface of the sanding pad; and suction means for applying suction to the plenum, wherein the sanding pad is formed with a plurality of apertures extending through its thickness, the sanding pad also having formed into its sanding side a plurality of curved grooves, each of said grooves having an inner end communicating with a respective one of said apertures and having an outside end at a periphery of the sanding pad each groove curving forwardly in a direction of rotation of the sanding pad with a characteristic axis of each groove intersecting a tangent at the pad periphery at an angle in the range 110°-120°.

6. A mechanism for suppressing dust emissions from a power sander comprising a sanding pad driven in one of a rotary or a combined rotary and orbital motion to sand a surface of a workpiece, the sanding pad having a sanding side and an inner side, comprising:

a plenum formed in a body portion of the sander so as to extend around a drive shaft of the sander to which the sanding pad is operationally attached, the plenum being partially defined by the inner surface of the sanding pad; and suction means for applying suction to the plenum, wherein the sanding pad is formed with a plurality of apertures extending through its thickness, the sanding pad also having formed into its sanding side a plurality of grooves, each of said grooves having an inner end communicating with a respective one of said apertures and having an outside end at a periphery of the sanding pad, and said suction means comprises a suction manifold for applying a suction thereto, said suction manifold further comprising a plurality of suction ports communicating with said plenum at a plurality of predetermined locations.

7. The mechanism according to claim 6, wherein:

said suction manifold comprises a U-shaped passage fitted to an outside portion of the power sander; and a plurality of manifold extensions extending from said suction parts of said manifold to provide suction to said plenum.

8. The mechanism according to claim 5, wherein:

said plenum is defined in part by a flexible member fittable to an outside of said body portion of the sander so as to extend therefrom a lip portion disposed close to said inner surface of the sanding pad.

9. A mechanism for suppressing dust emissions from a power sander comprising a sanding pad driven in one of a rotary or a combined rotary and orbital motion to sand a surface of a workpiece, the sanding pad having a sanding side and an inner side, comprising:

a plenum formed in a body portion of the sander so as to extend around a drive shaft of the sander to which the sanding pad is operationally attached, the plenum being partially defined by the inner surface of the sanding pad; and suction means for applying suction to the plenum, wherein the sanding pad is formed with a plurality of apertures extending through its thickness, the sanding pad also having formed into its sanding side a plurality of grooves, each of said grooves having an inner end communicating with a respective one of said apertures and having an outside end at a periphery of the sanding pad, said plenum is defined in part by a flexible member fittable to an outside of said body portion of the sander so as to extend therefrom a lip portion disposed close to said inner surface of the sanding pad, said suction means comprises a suction manifold for applying a suction thereto, said suction manifold further comprising a plurality of suction ports communicating with said plenum at a plurality of predetermined locations, said suction manifold comprises a U-shaped passage fitted to an outside portion of the power sander and a plurality of manifold extensions extend from said suction ports of said manifold to provide suction to said plenum.

10. The mechanism according to claim 5, further comprising:

an abrasive layer attached to the sanding side of said sanding pad, said abrasive layer having formed therein a plurality of apertures disposed in correspondence with the apertures of the sanding pad.

11. An improved hand-held, power-driven sander, comprising:

drive means for generating a drive motion;

sanding means driven by said drive means for sanding a surface of a workpiece;

a plenum formed in a body portion of the sander; and suction means for applying suction to said plenum, wherein said sanding means comprises a sanding pad formed to have a sanding surface and an inside surface, the inside surface of the sanding pad partially defining said plenum to which suction is applied, the sanding pad also being provided with a plurality of apertures extending from the sanding surface to the inside surface and a plurality of curved grooves formed into the sanding surface with each groove having an inside end communicating with a corresponding one of said apertures and having an outside end at an outside periphery of the sanding pad each groove curving forwardly in a direction of rotation of the sanding pad with a characteristic axis of each groove intersecting a tangent at the pad periphery at an angle in the range of 110°-120°.

12. The sander according to claim 11, further comprising:

a flexible element fitted to an outside portion of the sander, the flexible element having a rim disposed to be immediately adjacent the inner surface of the sanding pad to thereby partially define said plenum.

13. The sander according to claim 12, wherein:

said drive means comprises a compressed air motor and means for providing a supply of compressed air thereto and a means for removing exhausted compressed air therefrom through an aspirator means providing vacuum to said plenum.

14. An improved hand-held, power-driven sander, comprising:

drive means for generating a drive motion;

sanding means driven by said drive means for sanding a surface of a workpiece;

a plenum formed in a body portion of the sander;

suction means for applying suction to said plenum, wherein said sanding means comprises a sanding pad formed to have a sanding surface and an inside surface, the inside surface of the sanding pad partially defining said plenum to which suction is applied, the sanding pad also being provided with a plurality of apertures extending from the sanding surface to the inside surface and a plurality of grooves formed into the sanding surface with each groove having an inside end communicating with a corresponding one of said apertures and having an outside end at an outside periphery of the sanding pad; and a flexible element fitted to an outside portion of the sander, the flexible element having a rim disposed to be immediately adjacent the inner surface of the sanding pad to thereby partially define said plenum, wherein said drive means comprises a compressed air motor and means for providing a supply of compressed air thereto and a means for removing exhausted compressed air therefrom through an aspirator means providing vacuum to said plenum, and said suction means comprises a suction manifold fitted to an outside portion of the sander, the suction manifold having a plurality of suction ports communicating at a corresponding plurality of locations with the plenum.

15. The sander according to claim 13, wherein:

said drive means comprises an electric motor and said suction means comprises a suction manifold fitted to an outside portion of the sander, the suction manifold having a plurality of suction ports communicating at a corresponding plurality of locations with the plenum.

16. The sander according to claim 14, wherein:

said apertures are symmetrically disposed with their respective centers located on a circle of predetermined radius with respect to an axis of the body; and each of said grooves is curved along its length.

17. The sander according to claim 16, wherein:

each of said grooves has a substantially semicircular transverse cross-section.

18. The sander according to claim 17, wherein:

said grooves are disposed such that the corresponding outside end of each groove is forward of the corresponding inside end in the direction of motion of the grooves.

* * * * *